US010661815B2

(12) United States Patent
Warren

(10) Patent No.: US 10,661,815 B2
(45) Date of Patent: May 26, 2020

(54) RAILWAY CAR HATCH COVER LATCH

(71) Applicant: Amsted Rail Company, Inc., Chicago, IL (US)

(72) Inventor: Richard Warren, Columbia, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 364 days.

(21) Appl. No.: 15/827,418

(22) Filed: Nov. 30, 2017

(65) Prior Publication Data

US 2019/0161096 A1 May 30, 2019

(51) Int. Cl.

| | |
|---|---|
| ***B61D 17/16*** | (2006.01) |
| ***B65D 90/00*** | (2006.01) |
| *B65D 90/10* | (2006.01) |

(52) U.S. Cl.

CPC ..... *B61D 17/16* (2013.01); *B61D 5/08* (2013.01); *B65D 90/10* (2013.01)

(58) Field of Classification Search

CPC ..... B61D 17/16; B61D 39/00; B61D 5/08; B65D 90/10

See application file for complete search history.

(56) References Cited

U.S. PATENT DOCUMENTS

| | | | | |
|---|---|---|---|---|
| 2,684,238 A | | 7/1954 | Robinson | |
| 3,786,955 A | | 1/1974 | Mowatt-Larssen | |
| 4,040,363 A | * | 8/1977 | Walk | B61D 7/00 105/377.11 |
| 4,549,325 A | | 10/1985 | Seyler | |
| 4,889,056 A | * | 12/1989 | Stewart | B61D 5/08 105/377.11 |
| 5,064,089 A | | 11/1991 | Schultz | |
| 5,438,935 A | | 8/1995 | Seltz | |
| 5,813,352 A | * | 9/1998 | Bramlett | B61D 17/16 105/377.07 |
| 5,960,980 A | * | 10/1999 | Burke | B61D 17/16 220/325 |
| 10,464,580 B2 | * | 11/2019 | Schmidt | B61D 5/08 |
| 2005/0205576 A1 | | 9/2005 | Badnara et al. | |
| 2007/0024063 A1 | | 2/2007 | Silverio et al. | |
| 2009/0158959 A1 | * | 6/2009 | Schultz | B61D 17/16 105/377.07 |

(Continued)

OTHER PUBLICATIONS

International Search Report and Written Opinion in corresponding International Application No. PCT/US2018/63365, dated Feb. 14, 2019, 9 pages.

*Primary Examiner* — Michael C Zarroli

(74) *Attorney, Agent, or Firm* — Amsted Industries Incorporated

(57) ABSTRACT

The present railway car hatch cover latch assembly includes a latch plate. One end of the latch assembly rod is affixed to a bracket, with the adjustable end usually comprising an eye at the end of a threaded shaft. The threaded shaft is received in a keeper. The keeper in turn supports and holds a coil spring between the eye and the keeper cap. A bent hooking rod has two upturned ends that hold the end of the coil spring nearest the eye. The center of the bent hooking rod extends from the keeper to form a receiver. A latch plate includes a pivot rod that extends through the receiver of the bent hooking rod. The latch paddle itself contacts and holds the hatch cover is a compressively closed position against the railway car hatch ring.

8 Claims, 3 Drawing Sheets

(56) References Cited

U.S. PATENT DOCUMENTS

| | | | |
|---|---|---|---|
| 2013/0008340 | A1 | 1/2013 | Douglas et al. |
| 2014/0237902 | A1 | 8/2014 | David et al. |
| 2014/0345493 | A1 | 11/2014 | Skibinski |

* cited by examiner

FIG. 3
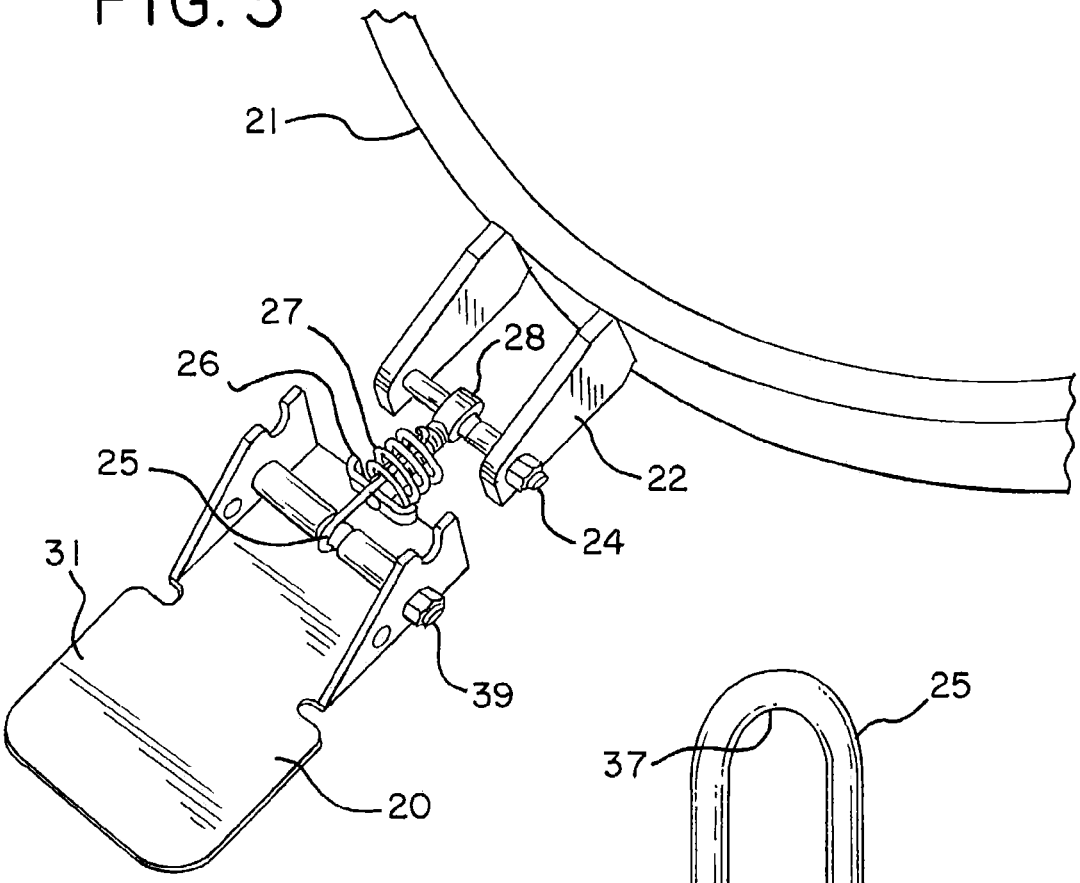
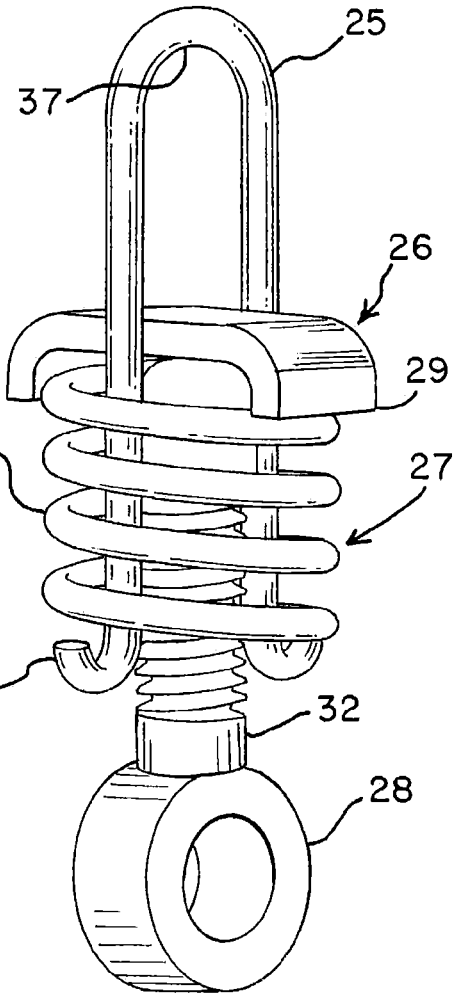
FIG. 4

RAILWAY CAR HATCH COVER LATCH

BACKGROUND OF THE INVENTION

The invention relates generally to railway car hatch covers, and more particularly to a latch for a railway car hatch cover.

This invention is applicable to railway car hatch covers. On covered hopper railway cars, each car has a series of hatches on top of the car that allow the railway cars to be filled from the top with various commodities, such as plastic pellets, flour, grain food products, and the like. The hatches also allow access into the car for maintenance and an opening for venting purposes. After the railway car is loaded, a hatch cover which includes a seal assembly is secured over each hatch to prevent outside substances from contaminating the goods in the car, and also to prevent spillage and secure the goods or substance inside the car for transportation. A latch is used in each hatch cover to secure the hatch cover and seal in a closed position.

It is desirable to include a type of latch assembly that is adaptable to variations in the seal due to wear in order to maintain a secure seal of the hatch cover onto the hatch itself.

The present invention provides a railway car hatch cover latch with a self-adjusting design that can provide a secure seal.

SUMMARY OF THE INVENTION

In accordance with the present invention, a latch is provided for use in a railway car hatch cover.

One embodiment of the present railway car hatch cover latch assembly includes a latch plate. An adjustable end of the latch assembly is affixed to the bracket, with the adjustable end usually comprising an eye at the end of a threaded shaft. The threaded shaft is received in a keeper. The keeper in turn supports and holds a coil spring between the eye and the keeper ears. A bent hooking rod has two upturned ends that hold the end of the coil spring nearest the eye. The center of the bent hooking rod extends from the keeper to form a receiver. A latch plate includes a pivot rod that extends through the receiver of the bent hooking rod. The latch plate itself contacts and holds the hatch cover is a compressively closed position against the hatch ring when the latch assembly is closed.

It is an object of the present invention to provide a latch for a railway car hatch cover that is adjustable to allow for a secure fit of the hatch cover on the railway car hatch.

DESCRIPTION OF THE DRAWINGS

FIG. 3. is a partial detailed perspective view of a latch and a railway car hatch ring in accordance with a first embodiment of the present invention.

FIG. 4 is a partial detailed perspective view of the adjustable latch mechanism for a railway car hatch cover in accordance with a first embodiment of the present invention;

DETAILED DESCRIPTION

Figure 1:
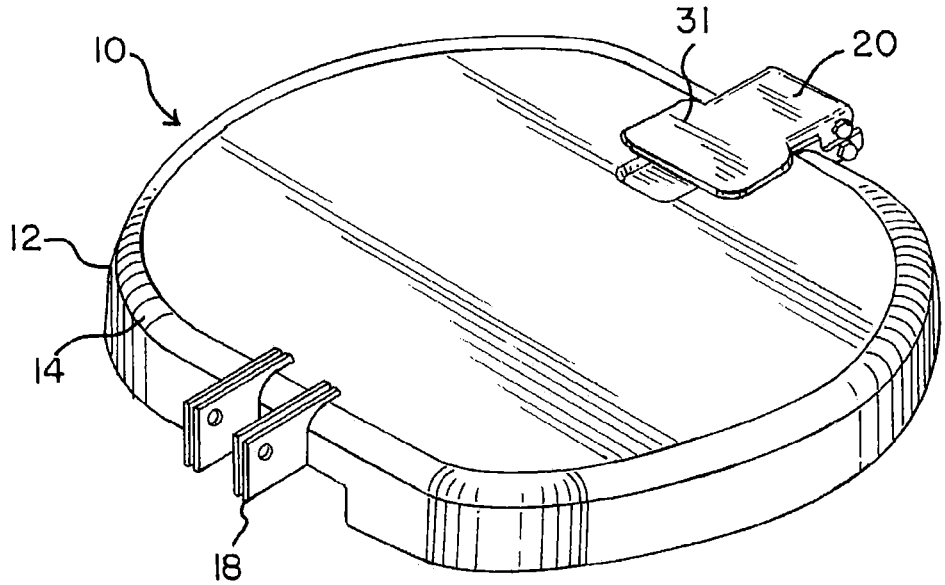
FIG. 1 is a perspective view of a latch and a railway car hatch cover in accordance with a first embodiment of the present invention.
Figure 2:
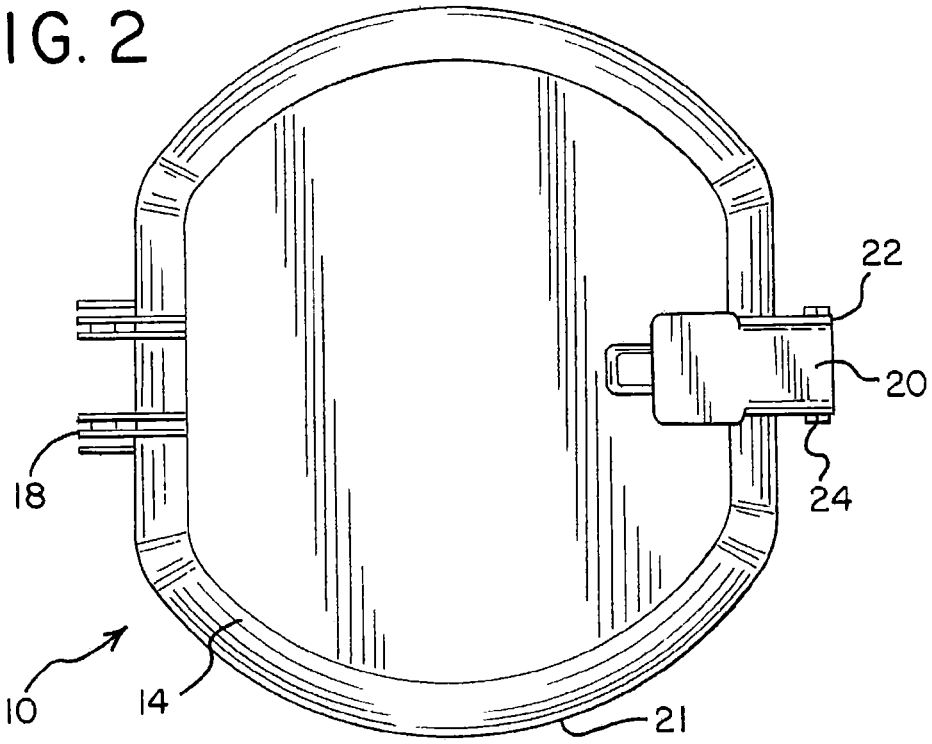
FIG. 2 is a top view of a latch and a railway car hatch cover in accordance with a first embodiment of the present invention.

Referring now to FIGS. 1-2, a railway car hatch cover is generally designated 10 and comprises an exterior shell cover 12 and latch assembly 20. The exterior shell cover 12 is generally round in the horizontal direction and dome-shaped in the vertical direction with respect to the railcar, but the exterior shell cover 12 can be of other shapes that cover the hatch opening. The exterior shell cover 12 has an outer-side 14 and an under-side 16. The exterior shell cover 12 is preferably molded from a polymeric material, but it can also be made from a metallic material. Hinges 18 connected to the outer-side 14 of the exterior shell cover 12 pivotally connect the railway car hatch cover 10 to a set of hatch hinges 18 on top of a railway car (not shown). Hinges 18 allow the exterior shell cover 12 to rotate between open and closed positions.

The hatch cover can be opened by hand. Hatch covers on a hopper car need to be opened and closed frequently during use, because solid materials such as food product, plastic pellets, grains, and the like are loaded into the railway cars through the hatch openings on top of the cars.

Referring now to FIGS. 3-4, securing latch 20 is connected to the securing latch hinges 22 through latch hinge bolt 24. Securing latch 20 is located opposite the hatch hinges 18 on the outer-surface 14 of the exterior shell cover 12. Securing latch 20 is a spring loaded mechanism that keeps a constant compressive force between hatch cover 10 and hatch ring 21 of the railcar hatch. When the exterior shell cover 12 is closed, and securing latch 20 is closed on top of exterior shell cover 12, securing latch 20 provides a spring compressive securing force on hatch cover 10. To open the exterior shell cover 12, securing latch 20 is rotated to an open position to release spring compression, allowing exterior shell cover 12 to be pivotally rotated and opened.

When exterior shell cover 12 is rotated to the closed position and securing latch 20 is rotated to a closed position, a compressive, self-adjusting spring force keeps shell cover 12 tightly sealed against hatch ring 21. The seal prevents contaminants from entering the interior of the railcar while the hatch cover is closed.

Securing latch assembly 20 is comprised of a latch plate 31. An adjustable end of securing latch assembly 20 is affixed to latch hinges 22 through latch hinge bolt 24, with the adjustable end usually comprising an eye 28 at the end of a threaded shaft 32. The other end of threaded shaft 32 is received in a keeper 26. The operational length of threaded shaft 32 can be adjusted by threading into keeper 26. Keeper 26 in turn supports and holds a coil spring 27 between eye 28 and keeper ears 29. A bent hooking rod 25 has two upturned ends 35 that hold the end of the coil spring 36 nearest eye 28. The center 37 of the bent hooking rod 25 extends from the keeper 26 to form a receiver 37. Latch plate 31 includes a pivot rod 39 that extends through the receiver 37 of the bent hooking rod 25. The latch plate 31 itself, when latch assembly 20 is in a closed position, contacts and holds the hatch cover exterior shell cover 12 in a compressively closed position against hatch ring 21.

Figure 5:
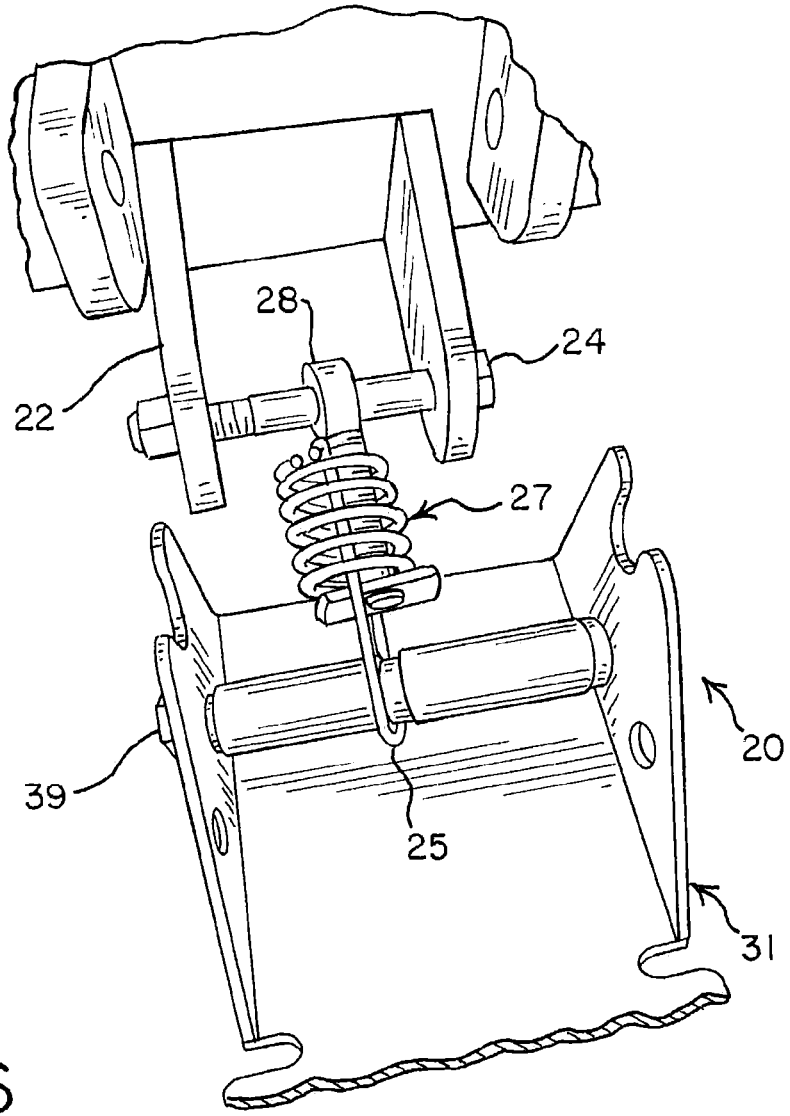
FIG. 5 is a partial detailed perspective view of a latch and a railway car hatch cover in an open position in accordance with a first embodiment of the present invention.
Figure 6:
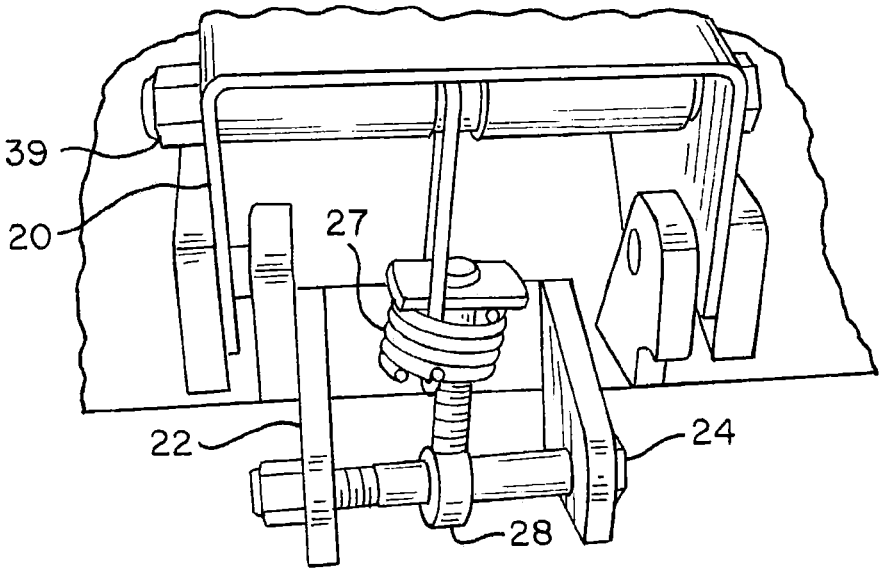
FIG. 6 is a partial detailed perspective view of a latch and a railway car hatch cover in a closed position in accordance with a first embodiment of the present invention.

Referring to FIG. 5, latch assembly 20 is shown in an open or unlatched position. Coil spring 27 is seen to be in a non-compressed position. Referring to FIG. 6, latch assembly 20 is shown in a closed or latched position wherein latch plate 31 contacts and holds hatch cover exterior shell cover 12 closed against hatch ring 21. Coil spring 27 is seen to be in a compressed position to add closing force to latch plate 31.

What is claimed is:

1. A railway car hatch cover latch assembly comprising
a hatch cover,
a latch plate,
a hatch ring of a railway car,
support brackets having a latch plate support rod,
a shaft having an eye at one end of the shaft,
the latch plate support rod extending through the shaft eye,
a keeper having an open end to receive a second end of the shaft,
the keeper also having a cap end,
a coil spring between the eye of the shaft and the cap end of the keeper,
a hooking rod having two upturned ends that hold an end of the coil spring nearest the eye of the shaft,
a center of the bent hooking rod extending from the keeper cap end to form a receiver,
a latch plate pivot rod extending through the receiver of the bent hooking rod,
wherein the latch plate contacts and holds the hatch cover in a compressively closed position against the hatch ring of the railway car when the latch assembly is closed.

2. The railway car hatch cover latch assembly of claim 1 wherein the second end of the shaft is threaded to allow for an adjustable amount of insertion into the open end of the keeper.

3. The railway car hatch cover latch assembly of claim 1 wherein the coil spring is compressed upon closing of the latch assembly such that the latch plate holds the hatch cover in the compressively closed position.

4. The railway car hatch cover latch assembly of claim 1 wherein the coil spring is un-compressed upon opening of the latch assembly.

5. A railway car hatch cover latch assembly comprising
a hatch cover,
a latch plate,
a hatch ring of a railway car,
support brackets on the hatch ring holding a latch plate support rod,
a shaft having an eye at one end of the shaft,
the latch plate support rod extending through the shaft eye,
a keeper having an open end to receive a second end of the shaft,
the keeper also having a cap end,
a coil spring surrounding the shaft and located between the eye of the shaft and the cap end of the keeper,
a hooking rod having two upturned ends that provide a stop for an end of the coil spring nearest the eye of the shaft,
a center of the bent hooking rod extending from the keeper cap end to form a receiver,
a latch plate pivot rod extending through the receiver of the bent hooking rod,
wherein the latch plate contacts and holds the hatch cover in a compressively closed position against the hatch ring of the railway car when the latch assembly is closed.

6. The railway car hatch cover latch assembly of claim 1 wherein the second end of the shaft is threaded to allow for an adjustable amount of insertion into the open end of the keeper.

7. The railway car hatch cover latch assembly of claim 1 wherein the coil spring is compressed upon closing of the latch assembly such that the latch plate holds the hatch cover in the compressively closed position.

8. The railway car hatch cover latch assembly of claim 1 wherein the coil spring is un-compressed upon opening of the latch assembly.

* * * * *